US006895680B2

(12) United States Patent
Spencer et al.

(10) Patent No.: US 6,895,680 B2
(45) Date of Patent: May 24, 2005

(54) GOLF HEAD AND SHAFT WITH FLEX NEUTRALIZATION AND METHOD FOR MANUFACTURING SAME

(76) Inventors: David P. Spencer, 4317 Baywood Dr., Huntsville, AL (US) 35805; Max L. Lee, 4317 Baywood Dr., Huntsville, AL (US) 35805; David Bechtel, 4317 Baywood Dr., Huntsville, AL (US) 35805

( * ) Notice: Subject to any disclaimer, the term of this patent is extended or adjusted under 35 U.S.C. 154(b) by 0 days.

(21) Appl. No.: 09/917,076

(22) Filed: Jul. 27, 2001

(65) Prior Publication Data

US 2003/0022727 A1 Jan. 30, 2003

(51) Int. Cl.[7] ..... G01B 1/00
(52) U.S. Cl. ..... 33/508
(58) Field of Search ..... 33/508, 645, 613, 33/286, 533

(56) References Cited

U.S. PATENT DOCUMENTS

| | | | | | |
|---|---|---|---|---|---|
| 1,675,437 | A | * | 7/1928 | Waldron | 144/118 |
| 2,660,436 | A | * | 11/1953 | Grossman | 33/508 |
| 3,577,771 | A | * | 5/1971 | Solheim | 177/246 |
| 3,822,477 | A | * | 7/1974 | Collins | 33/508 |
| 4,204,332 | A | * | 5/1980 | Gray | 33/508 |
| 4,245,391 | A | * | 1/1981 | Heller | 33/508 |
| 4,245,392 | A | * | 1/1981 | Heller | 33/508 |
| 4,858,332 | A | * | 8/1989 | Thomas | 33/1 N |
| 4,884,813 | A | * | 12/1989 | Cates | 33/508 |
| 5,105,550 | A | * | 4/1992 | Shenoha | 33/1 N |
| 5,205,561 | A | * | 4/1993 | Lux | 473/232 |
| 5,234,217 | A | * | 8/1993 | Johnson | 473/238 |
| 5,421,098 | A | * | 6/1995 | Muldoon | 33/334 |
| 5,540,090 | A | * | 7/1996 | Wheatley | 33/508 |
| 5,839,181 | A | * | 11/1998 | Chu | 29/281.5 |
| 5,864,960 | A | * | 2/1999 | DeNicolo et al. | 33/508 |
| 5,870,815 | A | * | 2/1999 | Karner et al. | 29/281.1 |
| 6,298,546 | B1 | * | 10/2001 | Slota | 29/720 |
| 6,449,860 | B1 | * | 9/2002 | Nakai | 33/508 |
| 2002/0157270 | A1 | * | 10/2002 | Maraschiello | 33/508 |

* cited by examiner

*Primary Examiner*—Diego Gutierrez
*Assistant Examiner*—Amy R. Cohen
(74) *Attorney, Agent, or Firm*—Joseph T. Guy; Nexsen Pruet, LLC

(57) ABSTRACT

A device for determining a neutral point on a golf club head. The device comprises a base. A calibration block is attached to the base. The calibration block comprises an index dial and the index dial comprises a neutral indicator. A head aligner is rotatably attached to the base opposite to the calibration block. The head aligner comprises a groove aligner and a sole plate. When the sole plate is in contact with a club sole of the golf club head and the groove aligner is aligned with a club groove of the golf club head the neutral point is aligned with the neutral indicator.

4 Claims, 5 Drawing Sheets

GOLF HEAD AND SHAFT WITH FLEX NEUTRALIZATION AND METHOD FOR MANUFACTURING SAME

TECHNICAL FIELD

The present invention is related to golf clubs and the assembly, or manufacture, thereof wherein the neutral point of a golf club head and the neutral flex point of a golf shaft have a predetermined relationship. More specifically, the present invention is related to a device for accurately, and rapidly determining the neutral point of a golf club head or for preparing golf clubs or golf club head blanks.

BACKGROUND

It is well known that golf shafts are asymmetric with respect to the force required to bend the shaft in different directions to a given flex point. This asymmetry, referred to as a neutral flex point, spine line or weld line, typically occurs as a result of the manufacture of the shaft. When golf clubs are manufactured the asymmetry is often ignored resulting in a set of golf clubs which, by visual inspection, are matched yet the flex of sister clubs may vary due to the different rotation of the flex assymetry relative to the neutral position of the golf head.

It has long been the desire to mitigate the differences by aligning the neutral flex point in a consistent orientation relative to the club head. For example, Colbert in U.S. Pat. No. 4,958,834 describes the desire to align the shaft seam with the club face in a consistent manner yet the manner in which this is done is not set forth except as a visual technique.

Karner, et al., U.S. Pat. No. 5,771,552 teaches the alignment of a golf shaft with a squared club for aesthetics. The device of Karner, et al., has several deficiencies. First, the club face may be concave or convex which would provide a faulty alignment of the club relative to the shaft alignment window. For example, if the club face is concave, a club head which is slightly forward (towards the toe) may be oriented with the toe behind the heel in a configuration typically resulting in a slice. This is acceptable for aesthetics but could be unacceptable if accuracy in aligning flex properties were desired.

Ciccarello et al., U.S. Pat. No. 5,976,028, describes a method for determining the neutral flex point, or shaft seam. There is no indication in Ciccarello et al. how a skilled artisan could align a shaft properly with the golf head. To date the alignment has been done by visual inspection.

It has long been felt in the industry that the effect of proper use of the shaft assymetry could enhance the performance of a golf club. While this has been the opinion it has not yet been fully tested since the methods for accurately orienting the shaft assymetry has been lacking. For example, alignment of the shaft asymmetry with a device such as Karner et al. would provide some information yet the ability to accurately deviate from the square position to test for regions of improved properties is lacking. There is no technique for aligning a shaft neutral flex point at a non-neutral optimal position, for example +15° from neutral, except for visual estimation which is unacceptable. Furthermore, even if improved properties are realized from the studies which are only now made available with the present invention there is no manner in which the improvement could be utilized since there is no method for accurately orienting the club face and the shaft assymetry prior to the present invention.

Yet another problem in the art is the inability to determine the relationship between the shaft asymmetry and golf head in a prepared club. Prior to preparation, the shaft assymetry can be located as described in the cited art. After the club head is secured to the shaft there is no way of determining, without disassembly, if the golf shaft is aligned in any specific orientation.

There has been a long felt desire in the art for a method of accurately aligning a golf club head with a shaft neutral flex point repeatedly. There has also been a desire to determine, after assembly, the alignment of the shaft neutral flex point with the golf head.

SUMMARY

It is an object of the present invention to provide a method for manufacturing and assembling golf clubs which allows for the optimum orientation of the shaft neutral flex point, or shaft flex assymetry, and the golf club head.

It is another object of the present invention to provide a device which provides accurate and sure orientation of a golf club head and a shaft neutral flex point.

It is another object of the present invention to provide a method for determining the rotational orientation of a shaft neutral flex point with a golf head after assembly.

A particular feature of the present invention is the ability to orient the shaft neutral flex point and the golf club head in a specific position repeatedly through a set of golf clubs so that a matched set can be prepared with a custom orientation.

These and other advantages, as will be realized are provided in a golf club head comprising a mark indicating a neutral point Other advantages are provided in a device for determining a neutral point on a golf club head. The device comprises a base. A calibration block is attached to the base. The calibration block comprises an index dial and the index dial comprises a neutral indicator. A head aligner is rotatably attached to the base opposite to the calibration block. The head aligner comprises a groove aligner and a sole plate. When the sole plate is in contact with a club sole of the golf club head and the groove aligner is aligned with a club groove of the golf club head the neutral point is aligned with the neutral indicator.

Yet another advantage is provided in a golf club comprising a golf club head wherein the golf club head comprises a golf club mark indicating a neutral point. The golf club further comprises a golf shaft with a spine mark indicating a spine line or neutral flex point wherein the spine mark and golf club mark are aligned.

Yet another advantage is provided in a method for manufacturing a golf club. The method comprises the steps of a) inserting a golf club head in a device for determining a neutral point on said golf club head wherein the device comprises:
   - a base;
   - a calibration block attached to the base wherein the calibration block comprises an index dial and the index dial comprises a neutral indicator;
   - a head aligner rotatably attached to the base opposite to the calibration block wherein the head aligner comprises a groove aligner and a sole plate wherein when the sole plate is in contact with a club sole of the golf club head and the groove aligner is aligned with a club groove of the golf club head the neutral point is aligned with the neutral indicator;

b) placing a mark on the golf club head at the neutral point;

c) inserting a golf shaft wherein a neutral flex point of the golf shaft aligns with the mark.

DETAILED DESCRIPTION

The invention will be described with reference to the drawings wherein similar elements are numbered accordingly.

The location of the neutral point of the golf club head will be described with reference to FIGS. 1 and 2. A golf club head, 1, which is an iron for the purposes of discussion, is shown in front view in FIG. 1 and rear view in FIG. 2. As would be apparent to one of ordinary skill in the art the ball is struck with the club face, 2. A first imaginary vector, 3, perpendicular to the face center, 4, is used as the basis for determining the neutral point. A second imaginary vector, 5, which is parallel to and coplanar with the first imaginary vector and passing through the geometric center of the hosel, 6, contacts the hosel end, at the neutral point, 7, and the point that is 180° from neutral referred to herein as the 180° point, 8. Any point on the hosel can then be referred to relative to the neutral point. As a matter of preferred convention, locations towards the toe of a right handed club head, or counterclockwise around the hosel, are referred to as positive angles relative to the neutral position and locations on the hosel towards the heel of a right handed club head, or clockwise, are referred to as negative angles relative to the neutral position. This convention could be reversed or other conventions could be adopted without departing from the scope of the present invention. The club face, 2, preferably comprises grooves, 9, which assist in imparting spin on the ball at impact. A neutral mark, 10, in the form of an indentation, protrusion or marking preferably indicates the neutral point of the club head. An index mark, 11, such as a number or letter, is preferably associated with the mark.

Figure 1:
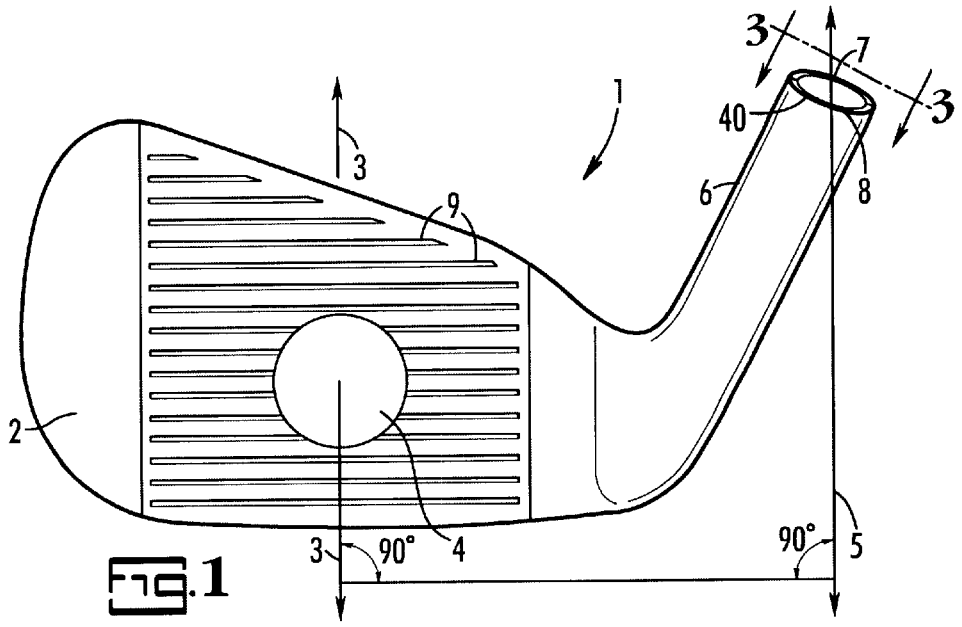
FIG. 1 is a front view of a golf club head illustrating the coordinate system within which the neutral position is determined.
Figure 3:
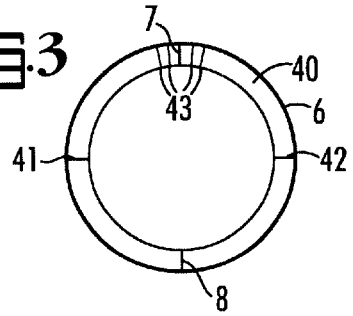
FIG. 3 is a top view of the hosel end taken along line 3—3 of FIG. 1.

FIG. 3 is an end view taken along line 3—3 of FIG. 1. In a preferred embodiment, the hosel end, 40, comprises marks, preferably indentations, score lines or protrusions, which form a calibrated scale relative to the neutral point, 7. For example, the 180° point, 8; +90° point, 41; −90° point, 42, and minor scale points, 43, can be provided to accurately indicate various angles relative to neutral.

Figure 2:
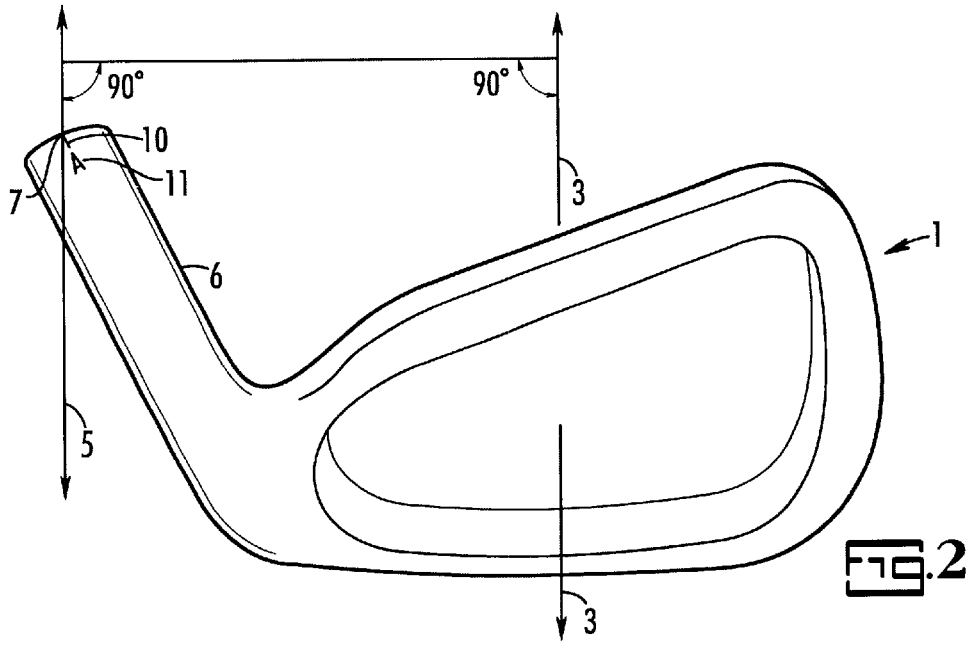
FIG. 2 is a back side view of the golf club head alignment of FIG. 1.

As well known in the art, and readily apparent from the description of the theoretical location of the neutral point relative to FIGS. 1 and 2, the actual determination in practice is a cause of some confusion and incorrect determination. The actual face center is not easily determined with most clubs. Furthermore, the club face may be concave, or convex which leads to additional difficulties determining the perpendicular line, 3, of the club face at the face center. This is important for determining the neutral point. A device which can reproducibly indicate the neutral point has long been desired without success.

Figure 4:
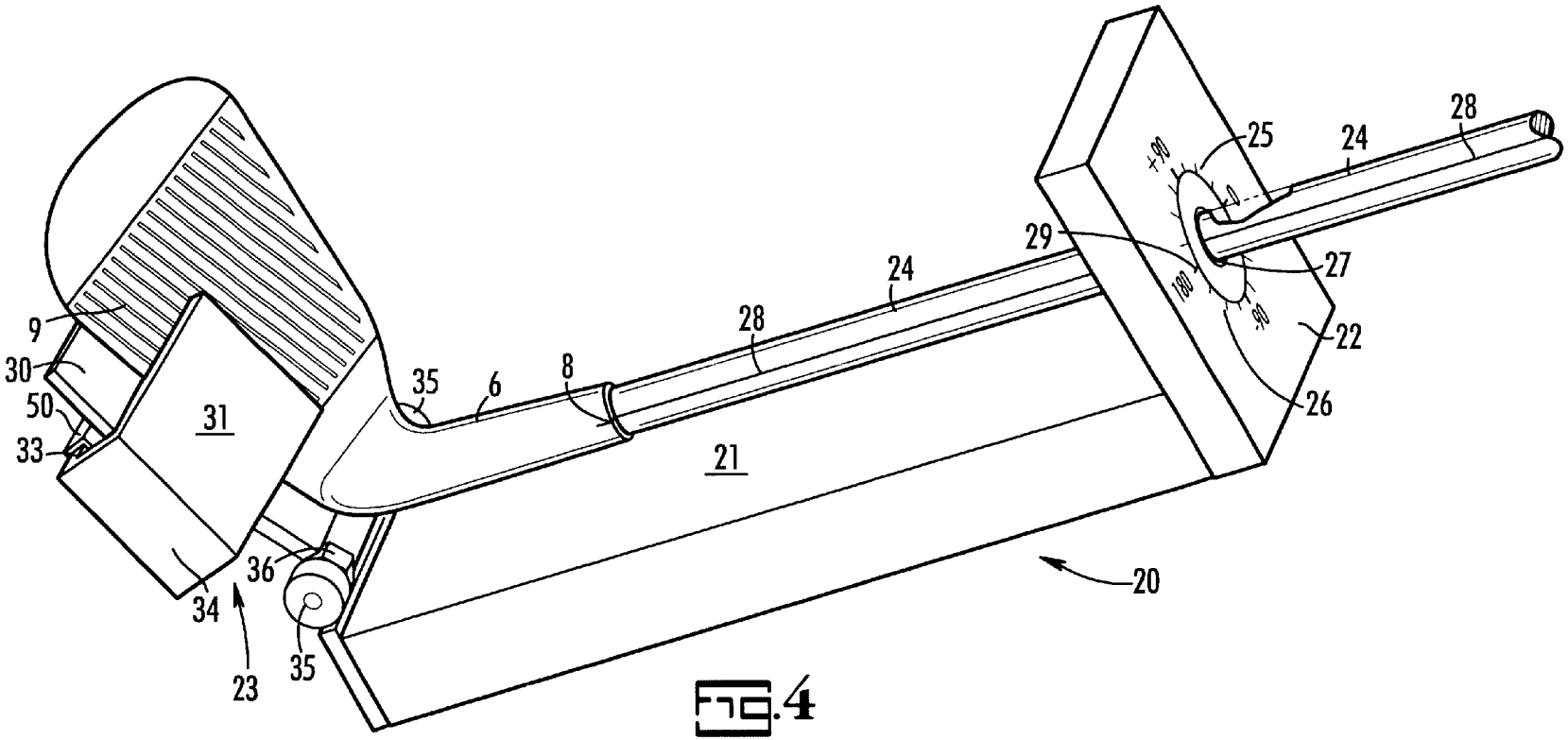
FIG. 4 is a front view of one embodiment of the present invention.

An inventive device for alleviating the difficulties of determining the neutral point is illustrated in front view in FIG. 4. The neutral point determination device, 20, comprises a base, 21, which can be attached to a table, bench or pedestal if so desired.

Integral to the base, 21, is a calibration block, 22, and a head aligner, 23, opposite the calibration block. The calibration block, 22, may be slidably attached to the base, 21. Integral to the calibration block is a shaft blank, 24, comprising a calibration line, 28. In the example illustrated in FIG. 1,the calibration line is at 180° relative to the neutral point. An index dial, 25, and calibration scale, 26, work in concert to indicate the rotational position of the calibration line, 28. The shaft blank and index dial are secured one to the other such that the calibration line is aligned with a mark, 29, on the index dial, 25. Therefore, as the index dial is rotated the rotational position of the calibration line can be read by visualizing the position of the mark relative to the calibration scale, 26. When a club head is properly inserted in the alignment device, as will be described further herein, the calibration line, 28, aligns with the 180° point, 8, of the hosel, 6, when the mark corresponds to 180° on the calibration scale. As would be apparent from the description herein the neutral point calibration device can be used to locate and mark the neutral point, or 180 point, or any point there between, on a golf club head or to confirm and calibrate the neutral point, or 180 point, on a golf club head marked to indicate a point. By rotating the index dial, 25, a golf club head with an incorrect neutral point can be realized and calibrated to account for the error. The shaft blank, 24, can be used to determine hosel depth by inserting into the hosel to the full extent and measuring the amount of shaft blank inserted therein.

The head aligner, 23, comprises a sole plate, 30, upon which the sole of the golf club head rest. A groove aligner, 31, slidably attached to the sole plate, 30, aligns with the grooves, 9, to insure that the golf club head is in the proper orientation. The groove aligner, 31, is parallel to the sole plate, thereby insuring that the grooves, 9, are parallel to the sole plate which necessarily places the club in the proper lie position regardless of the loft angle or lie angle of the golf club head. By fixing the golf club head in both lateral and rotational positions the orientation of the face of the club is determinate and in certain relationship to the calibrated block, 22, thereby rapidly and repeatedly fixing the neutral point of the club relative to the neutral detection device. More importantly, with the golf club head in the proper position relative to the sole plate and groove aligner the neutral point of the golf club head is aligned with the neutral point of the index dial.

In the embodiment illustrated in FIG. 4 the shaft blank, 24, (shown in partial cutaway view) protrudes through the index dial as shown. In one embodiment, the shaft blank is slidably received by the index dial but rotatably secured to the index dial by notches, gears or the like, to allow the shaft blank to be withdrawn from the hosel for removing the club head without disruption of the aligned relationship between the calibration line and the index dial.

Figure 5:
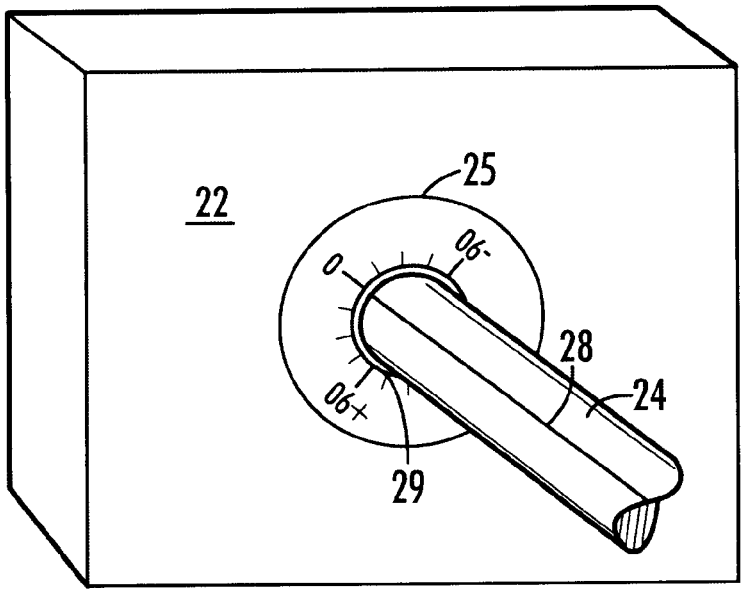
FIG. 5 is an end view of a preferred embodiment of the present invention.

A preferred embodiment of the calibration block, 22, is illustrated in FIG. 5. The calibration block, 22, comprises a void, 27, through which a shaft blank is inserted. Circumventing the void is the calibration scale, 25. In this embodiment the shaft blank is slidably received in the void and rotated to determine the position of a calibration line, 28. The calibration line, 28, can then be used as previously described.

Figure 6:
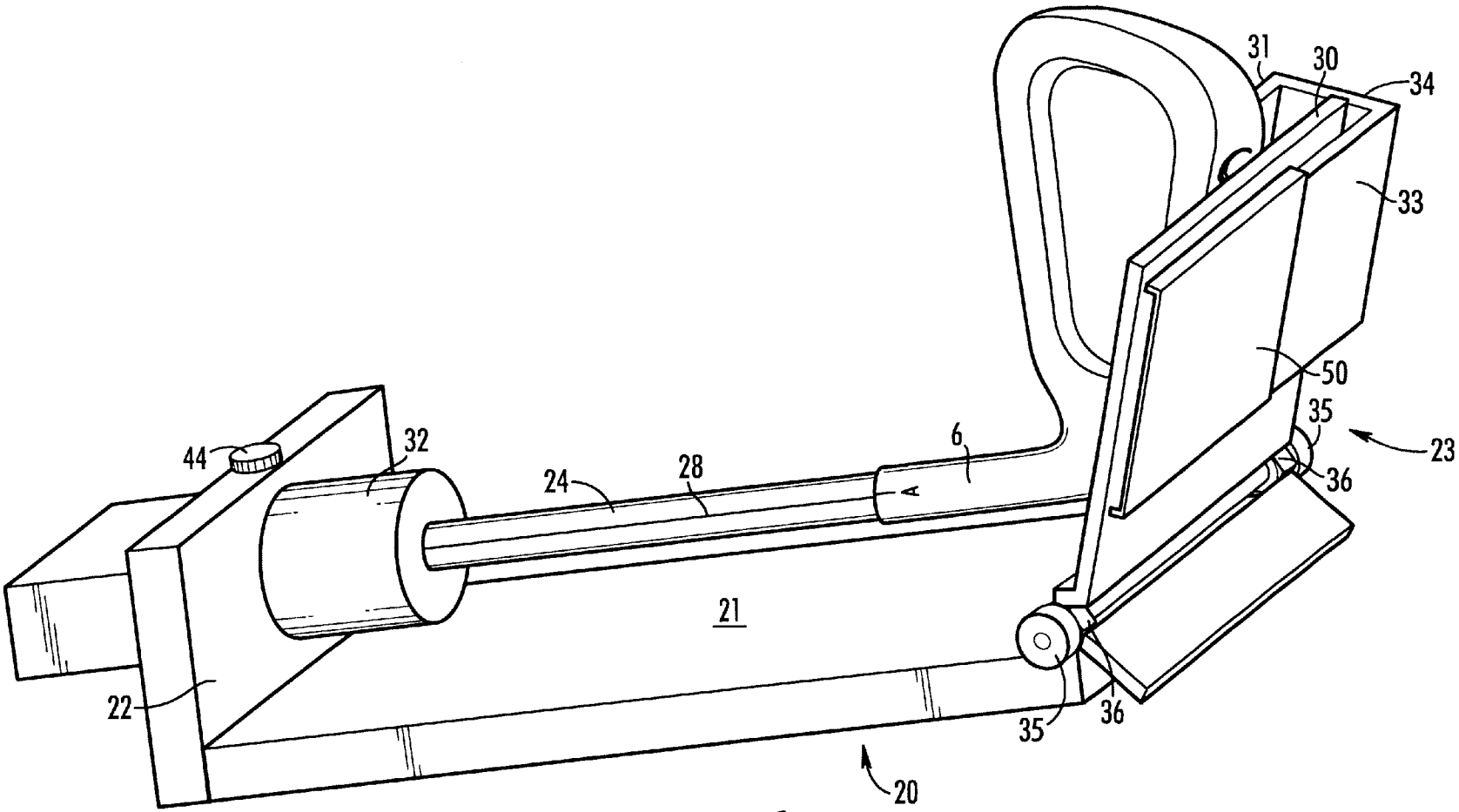
FIG. 6 is rear perspective view of an embodiment of the present invention.

Another embodiment of the present invention is illustrated in FIG. 6. In FIG. 6, the calibration line, 28, is provided on the shaft blank, 24. The shaft blank, 24, is secured to a piston, 32, which is slidably received by the calibration block, 22. The piston, 32, may further comprise a index dial thereon with the shaft blank rotatably received by the piston as illustrated relative to FIG. 4. An optional securing knob, 44, can engage with the piston to secure the location thereof.

A slide mount, 50, attached to the sole plate, 30, slidably receives a slide, 33, which is attached to the groove aligner, 31, by a riser, 34. The sole plate, 30, is rotatably attached to the base by threaded members, 35, which mate with matching threads in lugs, 36, of the base, 21, but allow the sole plate to freely rotate thereon. In another embodiment, the threaded member may be replaced with one or more axles.

Figure 7:
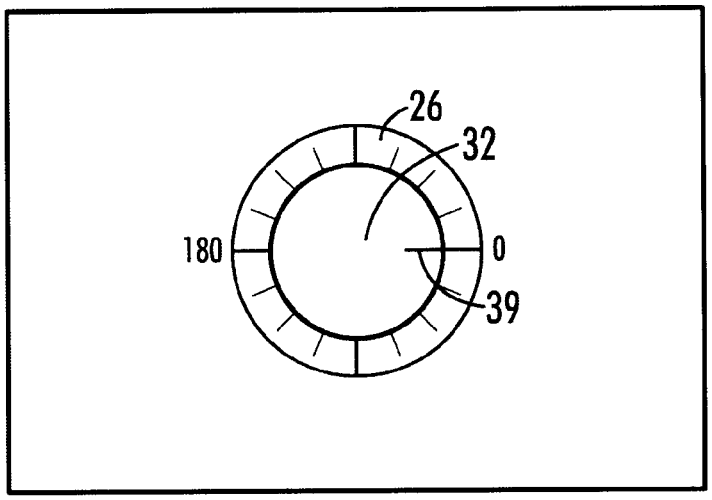
FIG. 7 is an end view of another preferred embodiment of the present invention.

An alternate preferred embodiment is illustrated in end view in FIG. 7 wherein a round piston is secured to the shaft blank, as described relative to FIG. 6, and slidably and rotationally received by the calibration block, 22. The piston, 32, comprises a calibration mark, 39, which is aligned with the calibration line of the shaft blank. This allows for shaft blanks of different sizes to be used with each secured to a piston which is inserted into the void of the calibration block, 22. This embodiment greatly increases the versatility of the apparatus.

As would be realized from the description herein, the golf club head can be marked, or etched to indicate the location of the neutral point. In a particularly preferred embodiment the golf club head is marked with an indentation to indicate the neutral point.

In a particularly preferred embodiment the golf shaft comprises a neutral flex mark to indicate the neutral position, spine line, or orientation of flex asymmetry.

Figure 8:
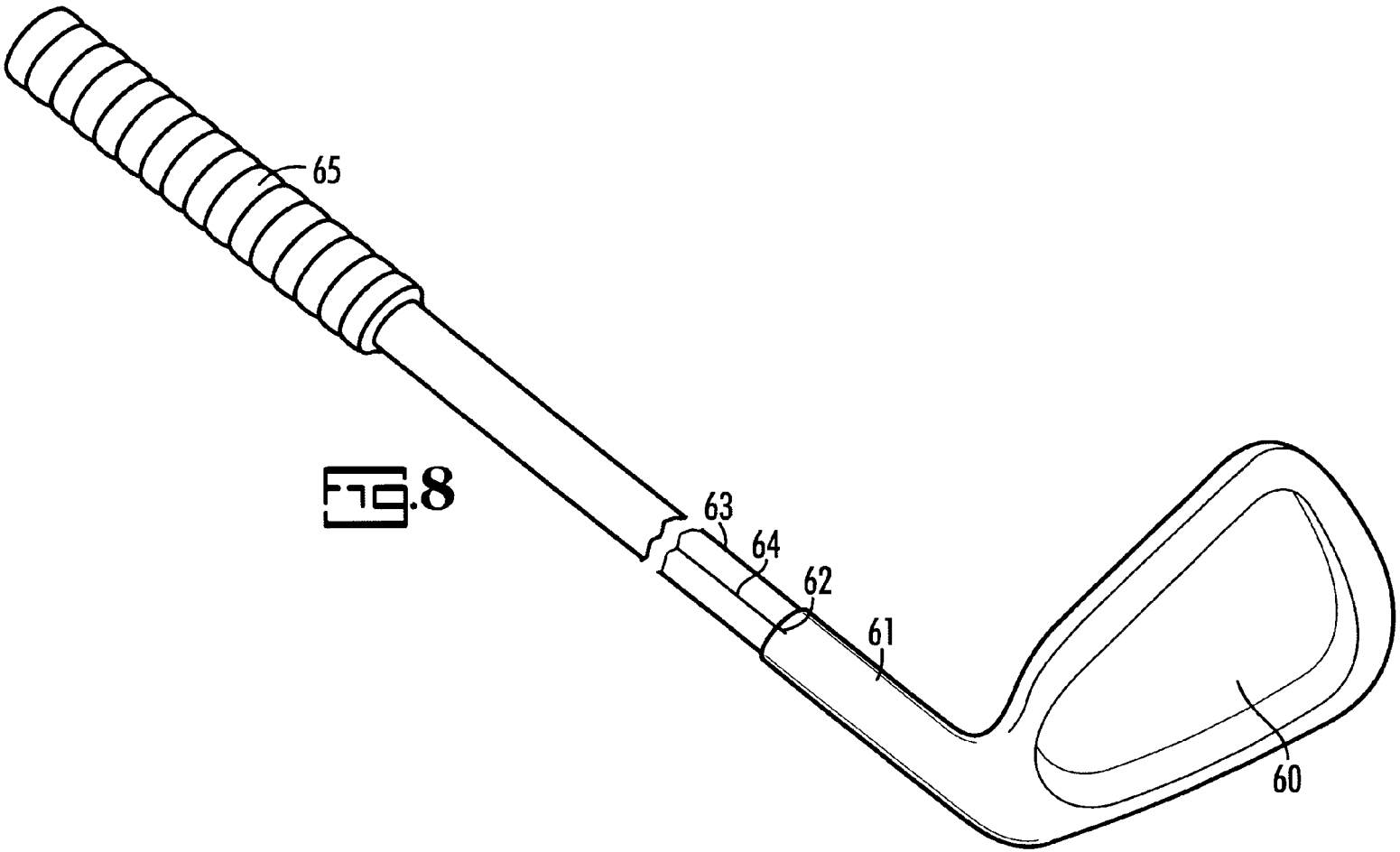
FIG. 8 is a golf club prepared in accordance with the present invention.

A golf club prepared in accordance with the present invention is provided in FIG. 8. In FIG. 8, the golf head, 60, comprises an optional hosel, 61. A neutral mark, 62, preferably in the form of an indentation, indicates the neutral point of the golf head. A shaft, 63, and associated grip, 65, are attached to the golf head in a manner wherein a neutral flex mark, 64, which indicates the neutral flex point, or spine line, of the shaft aligns with the neutral mark, 62, of the golf head. In this preferred embodiment a visual inspection can be made to determine if the neutral flex point and neutral point of the golf head are properly aligned or if in a forward position or reverse position to alter swing characteristics. This embodiment allows the observation and therefore consistent application of flex point and neutral point alignment which is now not available in the art of golf club manufacture.

In a particularly preferred embodiment, the ability to accurately indicate any point of rotation relative to neutral can be used to custom design golf clubs wherein the rotation of the shaft relative to the neutral point can be specified to improve performance for individual players with individual nuances in a golf swing.

While described and illustrated with a golf club head commonly referred to as an iron, this invention can be used with any golf club head design. For golf club heads with a hosel, such as that illustrated, the neutral mark is preferably on the end of the hosel. For golf club head which do not have a hosel, such as the bore-through shaft clubs, the neutral mark is on the club surface near the shaft bore. As would be realized it is preferred that the neutral mark be in a location that is easily aligned with markings on the shaft. Any type of golf club head can be used including putters, irons, drivers, etc. Throughout the description the references to golf club head can also apply to a golf club head blank or a golf club head mold. The invention can be used with a golf head blank which can be marked to indicate the neutral point. The neutral point is then incorporated into the golf head mold such that each golf club head comprises the neutral mark.

The shaft type is not limited herein. Any asymmetry in the flex of the shaft can be accommodated with the present invention. With current manufacturing techniques the flex asymmetry is typically imparted by welding a seam the length of the shaft. It is contemplated herein that further developments may alter shaft manufacture to other methods wherein different flex asymmetry may be imparted. The present invention is not limited by the manner in which flex asymmetry in a shaft occurs.

The invention has been describe with emphasis directed to the preferred embodiments. It would be apparent from the description herein that various embodiments could be developed without departing from the scope of the invention. Alternate methods of construction, operation and use could also be employed without departing from the scope of the invention which is set forth in the claims which follow.

What is claimed is:

1. A device for determining a neutral point on a golf club head comprising a hosel and further comprising:

a base;

a calibration block attached to said base wherein said calibration block comprises an index dial and said index dial comprises a neutral indicator wherein said neutral indicator indicates the relationship between the neutral point on the golf club head and the neutral flex point of a golf shaft; and a head aligner rotatably attached to said base opposite to said calibration block wherein said head aligner comprises a groove aligner and a sole plate wherein when said sole plate is in contact with a club sole of said golf club head and said groove aligner is aligned with a club groove of said golf club head said neutral point is aligned with said neutral indicator, and comprising a shaft blank, wherein said shaft blank comprises a calibration line, and wherein said shaft blank is aligned with said hosel.

2. The device of claim 1 further comprising a piston slidably received by said calibration block wherein said shaft blank is attached to said piston.

3. The device of claim 2 wherein said piston is round.

4. The device of claim 2 wherein said index dial is on said piston.

* * * * *